US010302402B2

(12) United States Patent
Achiaz

(10) Patent No.: US 10,302,402 B2
(45) Date of Patent: May 28, 2019

(54) MUNITIONS WITH INCREASED INITIAL VELOCITY PROJECTILE

(71) Applicant: Itai Achiaz, Herzelya (IL)

(72) Inventor: Itai Achiaz, Herzelya (IL)

( * ) Notice: Subject to any disclaimer, the term of this patent is extended or adjusted under 35 U.S.C. 154(b) by 467 days.

(21) Appl. No.: 14/680,163

(22) Filed: Apr. 7, 2015

(65) Prior Publication Data

US 2016/0305752 A1 Oct. 20, 2016

Related U.S. Application Data

(60) Provisional application No. 61/976,970, filed on Apr. 8, 2014.

(51) Int. Cl.

| | |
|---|---|
| ***F42B 12/76*** | (2006.01) |
| ***F41F 1/00*** | (2006.01) |
| ***F42B 12/04*** | (2006.01) |
| ***F42B 12/74*** | (2006.01) |
| ***F42B 12/80*** | (2006.01) |
| ***F42B 5/067*** | (2006.01) |
| ***F42B 14/06*** | (2006.01) |

(52) U.S. Cl.

CPC ..... *F42B 12/76* (2013.01); *F42B 12/80* (2013.01); *F42B 14/068* (2013.01)

(58) Field of Classification Search

CPC ..... F42B 5/067; F42B 12/04; F42B 12/74; F42B 12/76; F42B 12/80; F42B 14/068; F41F 1/00

USPC ..... 102/435, 438, 439, 441, 442, 444, 446, 102/447, 501, 514, 515, 516, 517, 520, 102/521, 522, 529

See application file for complete search history.

(56) References Cited

U.S. PATENT DOCUMENTS

| | | | | |
|---|---|---|---|---|
| 36,449 | A * | 9/1862 | Boekel | F42B 12/78 102/514 |
| 270,101 | A * | 1/1883 | Nordenfelt | F42B 12/78 102/514 |
| 926,431 | A * | 6/1909 | Luger | F42B 5/03 102/438 |

(Continued)

OTHER PUBLICATIONS

Liquidmetal Technologies, The Science, Jun. 8, 2013, Internet publication, pp. 1-5, archived at: https://web.archive.org/web/20130608014950/http://liquidmetal.com/properties/the-science, "LTS".*

(Continued)

*Primary Examiner* — Bret Hayes

(74) *Attorney, Agent, or Firm* — Myron Greenspan Lackenbach Siegel LLP

(57) ABSTRACT

A cartridge casing having an open neck at one axial end and a closed rear portion at the other axial end to form an interior cavity for propellant. A projectile within the open neck to seal the cavity so the bullet is released when the propellant is primed and ignited. The projectile has a proximate end releasably secured within the neck of the casing facing the cavity and exposed to the forces generated by ignited propellant. The remote end of the projectile is formed by a lead core while the proximate end has a transverse surface and is at least partially formed of an amorphous metallic alloy having properties of bulk metallic glass (BMG). Liquid metal alloy can also be used at the interface of a propellant chamber in a bore of a cannon and a cartridge-free projectile.

15 Claims, 5 Drawing Sheets

(56) References Cited

U.S. PATENT DOCUMENTS

| | | | | | |
|---|---|---|---|---|---|
| 2,045,833 | A * | 6/1936 | Childs | F42B 10/42 | 102/516 |
| 2,120,913 | A * | 6/1938 | Studler | F42B 5/025 | 102/516 |
| 2,386,054 | A * | 10/1945 | McGee | F42B 10/34 | 102/522 |
| 3,580,178 | A * | 5/1971 | Kopsch | F42B 12/82 | 102/515 |
| 4,043,269 | A | 8/1977 | Ambrosini | | |
| 4,256,039 | A * | 3/1981 | Gilman | F42B 12/74 | 102/517 |
| 4,805,536 | A * | 2/1989 | Kosteck | F42B 12/78 | 102/514 |
| 5,198,616 | A | 3/1993 | Anderson | | |
| 6,244,187 | B1 | 6/2001 | Head | | |
| 7,302,891 | B1 * | 12/2007 | Adams | F42B 5/025 | 102/439 |
| 8,291,828 | B2 | 10/2012 | Glasser | | |
| 8,434,410 | B2 | 5/2013 | AlSalem | | |
| 9,255,775 | B1 * | 2/2016 | Rubin | F42B 12/36 | |
| 2003/0101891 | A1 * | 6/2003 | Amick | F42B 12/34 | 102/514 |
| 2008/0035007 | A1 * | 2/2008 | Nielson | C06B 45/00 | 102/517 |
| 2014/0190364 | A1 * | 7/2014 | Peterson | F42B 7/08 | 102/439 |
| 2015/0308797 | A1 * | 10/2015 | Smith | F42B 5/067 | 102/464 |

OTHER PUBLICATIONS

Liquidmetal Technologies, Commercial Properties, Jun. 11, 2013, Internet publication, pp. 1-5, archived at: https://web.archive.org/web/20130611005415/http://liquidmetal.com/properties/properties/, "LTP".*

* cited by examiner

Fig. 3a
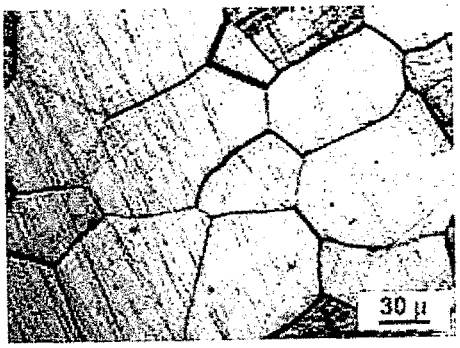
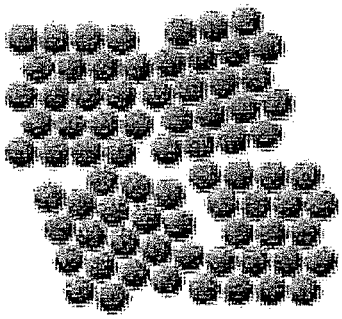
Fig. 3b
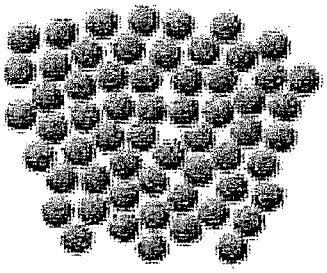
Fig. 3c
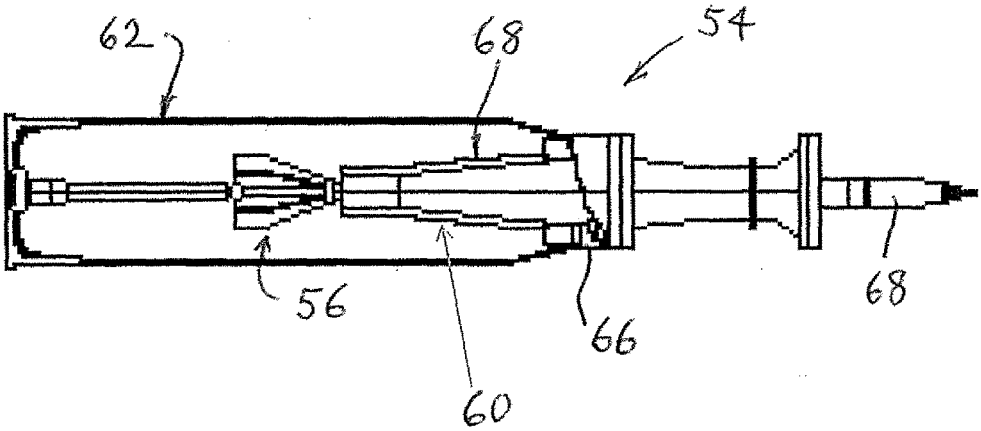
Fig. 11

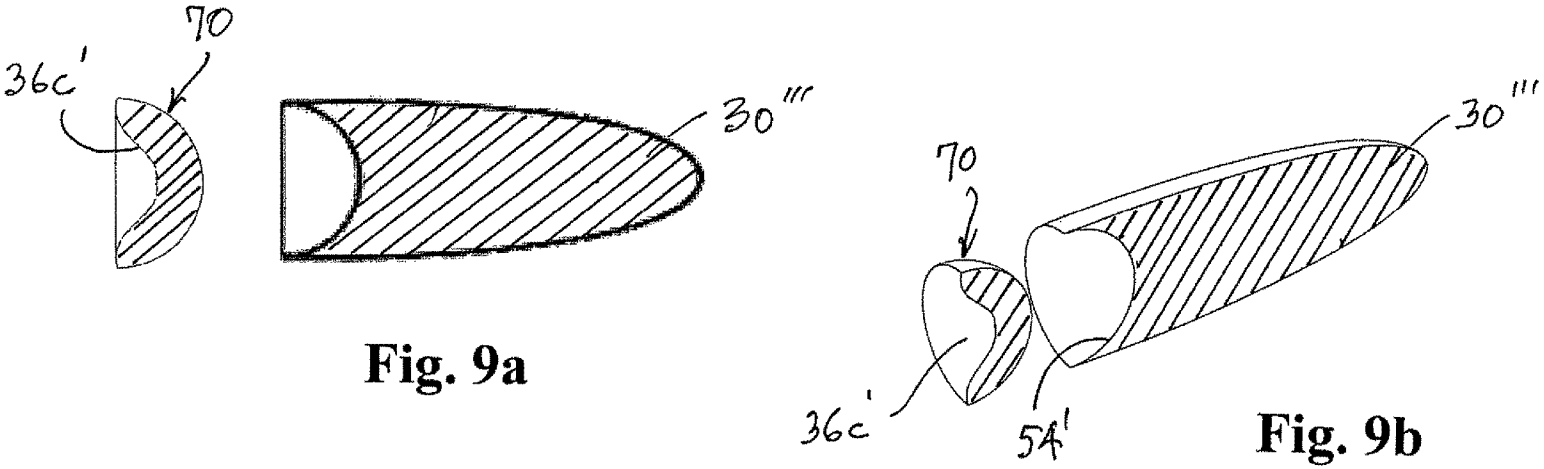
Fig. 9b
Fig. 9a
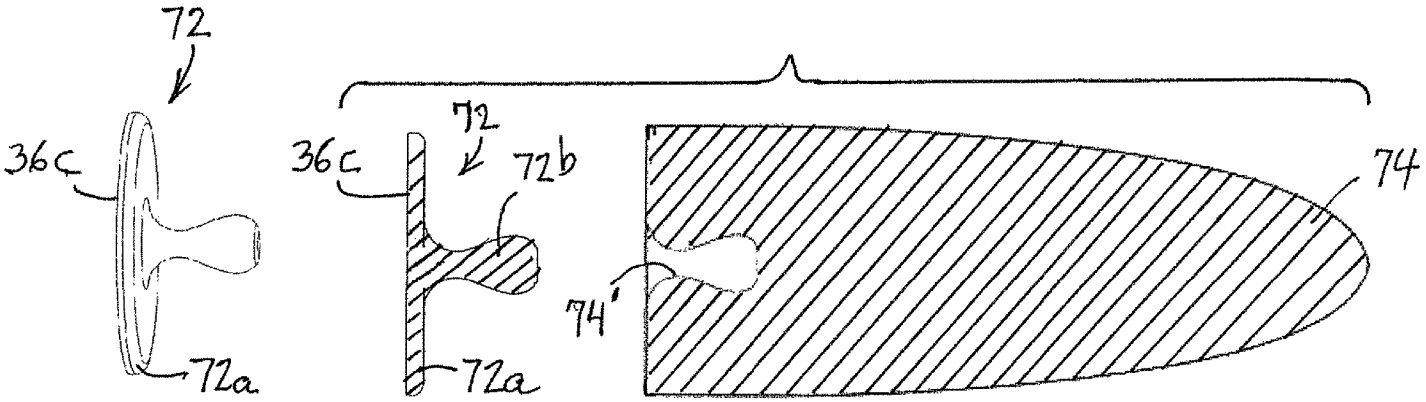
Fig. 10b
Fig. 10a

MUNITIONS WITH INCREASED INITIAL VELOCITY PROJECTILE

BACKGROUND OF THE INVENTION

1. Field of the Invention

This invention generally relates to ammunition and, more specifically, to munitions with an increased initial velocity projectiles.

2. Description of the Background Art

Ammunition cartridges have been in use for nearly as long as hand-held firearms, dating back to 1586. Cartridges are used with muzzle-loading military firearms as well as for sports shooting.

The history of bullets even predates the history of firearms, having been originally made out of stone or clay balls used as sling ammunition as weapons and for hunting. As firearms became more technologically advanced, from around 1500 to 1800, bullets changes very little. They remained simple round (spherical) lead balls called rounds differing only in their diameter.

The first pointed or "conical" bullets were designed for the British army in 1823, bullets have evolved since then and the modern bullet was developed in 1892 when the copper jacketed bullet, an elongated bullet with a lead core in a copper jacket, was-invented.

The surface of lead bullets fired at high velocity may melt due to hot gases behind and friction with the bore. Because copper has a higher melting point, and greater specific heat capacity and hardness, copper jacketed bullets allow greater muzzle velocities. The velocity of bullets increased with advances in aero-dynamics. These bullets traveled for greater distances more accurately and carried more energy with them.

Bullet design must address two primary problems. In the barrel they must first form a seal with the gun's bore. If a strong seal is not achieved, gas from the propellant charge leaks past the bullet thus reducing the efficiency and accuracy of the bullet. The bullet must also engage the barrel of the weapon without damaging or excessively fouling the gun's bore and without distorting the bullet which would also reduce accuracy. These interactions between the bullet and the bore are termed "internal ballistics".

Bullets for older firearms were classically molded from pure lead. This worked well for low speed bullets fired at velocities of less than 1,475 (ft/s). For higher speed bullets fired in modern firearms a harder alloy of lead and tin works well. For even higher speed bullets jacketed coated lead bullets are used. The common element in all of these bullets is lead, which is widely used because it is very dense, thereby providing a high amount of mass and, thus, kinetic energy for a given volume.

At speeds of greater than 1000 ft/s, common in most handguns, lead is deposited in riffle bores at an ever increasing rate. A cup made of a harder metal, such as copper, placed at the base of the bullet and called a "gas check" is often used to decrease lead deposits by protecting the rear of the bullet against melting when fired at higher pressures but this, too, does not solve the problem at higher velocities.

Bullets intended for even higher-velocity applications generally have a lead core that is jacketed or plated with a thin layer of gilding metal, such as cupronickel, copper alloys or steel. The thin layer of harder metal protects the softer lead core when the bullet is passing through the barrel and during flight which allows delivery of the bullet intact to the target. The heavy lead core delivers its kinetic energy to the target. Full metal jacket bullets are completely encased in the harder metal jacket except for the base. Steel bullets are often plated with copper or other metals for corrosion resistance during long periods of storage. The invention can also increase the initial velocities in non-cartridge-based munitions such as in canons where amorphous metallic alloy can be used to reduce energy losses generated by the propellant by covering the wadding or even the outer surfaces of the projectile with amorphous metallic alloy to maximize energy transfer to projectiles.

U.S. Pat. Nos. 6,244,187; 8,291,828 and 8,434,410 disclose attempt to increase the velocities of bullets. These patents also present descriptions of prior art attempt at increasing velocities of bullets and are incorporated as if fully set forth herein. As extensively discussed in U.S. Pat. No. 6,244,187 bullet manufacturers have produced bullets within a relatively narrow range of velocities ranging from 2000 f/ps-2700 f/ps. This is done to balance the different parameters, including exit velocities, range, penetration, etc. There is still a need to make cartridges more efficient and increase bullet velocities by harnessing as much of the energy released by the propellant without sacrificing the other properties of the bullet.

SUMMARY OF THE INVENTION

Accordingly, it is an object of the present invention to provide an increased velocity cartridge that does not have the disadvantages inherent in prior cartridges.

It is another object of the invention to provide an increased velocity cartridge that is simple in construction and economical to manufacture.

It is still another object of the invention to provide an increased velocity cartridge that maximizes the exit velocity of a bullet without sacrificing other design parameters or properties of the bullet.

It is yet another object of the invention to provide an increased velocity cartridge and bullet as in the previous objects that can be interchangeably used with other cartridges for existing firearms.

It is a further object of the invention to provide an increased velocity cartridge and bullet that requires nominal changes and modifications to existing bullet designs while achieving enhanced efficiency and optimized velocity.

In order to achieve the above objects, as well as other that will become apparent hereinafter, a cartridge with an increased velocity projectile comprises a generally cylindrical casing having an open neck at one axial end, a closed rear portion at the other axial end to form an interior cavity or chamber for propellant. Said rear portion includes means for priming the propellant. A projectile is provided within said open neck to initially seal said interior cavity or chamber for being releaseably mounted in said open neck to allow the projectile to be released when said propellant is primed and ignited. Said projectile defines an axis of symmetry and has a proximate end releasably secured within said neck of said casing facing said interior cavity or chamber and exposed to the forces generated by ignited propellant. The remote or leading end of the projectile is formed by a lead core while said proximate or trailing end has a surface cap layer at least partially formed of an amorphous metallic alloy having properties of bulk metallic glass (BMG). Such amorphous metallic alloy typically has yield strength in excess of 870 MPA, a hardness in excess of 340 Vickers and an elasticity in excess of 1.0%. The cap layer has the ability to restore energy imparted to the cap layer to reinforce the forces of the expanding propellant gases to increase the composite forces on the projectile to enhance its initial velocity.

In U.S. Pat. No. 4,043,269 a sealed sabot projectile is disclosed used in armor-piercing ammunition to provide high velocity and stability of the projectile in flight. The projectile is made of tungsten carbide, a heavy metal, to promote penetration through armor. In addition to using tungsten carbide, a heavy metal, to promote penetration through armor. In addition to using tungsten carbide at the leading or forward end of the shell or cartridge, it has also been used internally of cartridges, such as a penetrator rod in U.S. Pat. No. 5,198,616. However, materials use to interface surfaces on projectiles or sabots with the forces generated by explosive propellants have traditionally been made of metals having crystalline structures that have absorbed some of the energy, reducing the energy transferred to the projectiles or sabots. Such losses in energy have limited the maximum initial velocities that could otherwise be obtained if such losses were not incurred.

BRIEF DESCRIPTION OF THE DRAWINGS

Those skilled in the art will appreciate the improvements and advantages that derive from the present invention upon reading the following detailed description, claims, and drawings, in which:

FIG. 3*a* is an enlarged cross-section of an amorphous metallic alloy;

FIG. 3*b* is a graphical representation of a metal having a crystalline structure;

FIG. 3*c* is a graphical representation of an amorphous metallic alloy of the type shown in FIG. 3*a;*

FIGS. 9*a* and 9*b* are similar to FIGS. 5 and 6 of still a further embodiment of a bullet construction embodying the invention;

FIGS. 10*a* and 10*b* show a further configuration of bullet cap and exploded cross-sectional view of a bullet embodying the same; and FIG. 11 is a side elevational view, partially in cross-section, of an armor piercing, fin stabilized discarding sabot-tracer cartridge in which the surface of the sabot exposed to the explosion or combustion chambers is covered with a layer or coating of a hard amorphous metal in accordance with the invention;

DESCRIPTION OF PREFERRED EMBODIMENTS

Figure 1:
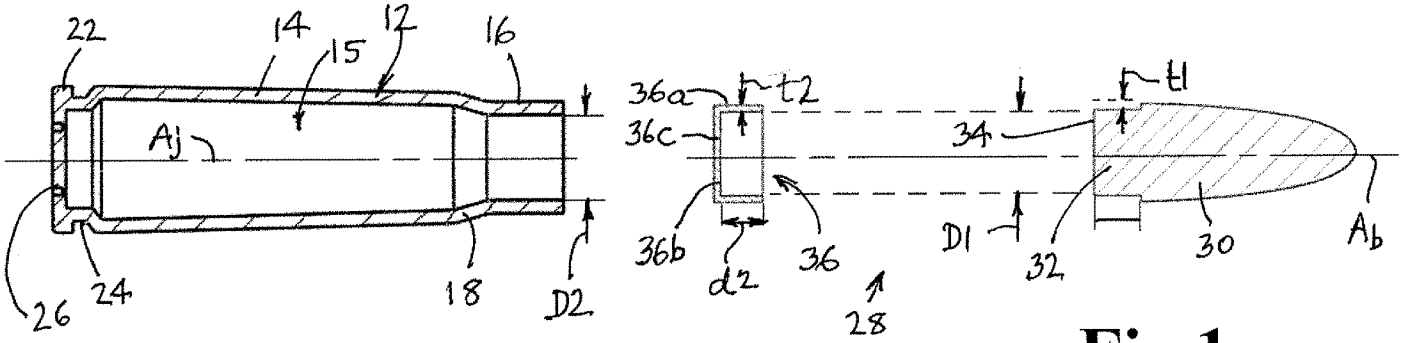
FIG. 1 is an exploded view, in cross section, of a cartridge incorporating a high velocity bullet in accordance with the present invention.

Referring now more specifically to the Figures, in which identical or similar parts are designated by the same reference numerals throughout and first referring to FIG. 1, a cartridge with an increased velocity bullet in accordance with the invention is generally designated by the reference numeral 10.

The cartridge, round or shell 10 includes a generally elongated case or jacket 12, typically formed of copper, having a tapered wall 14. The case or jacket 12 forms a cavity or chamber 15 and defines a longitude axis $A_j$ and an open mouth or end at 16, forming a neck reduced in diameter by intermediate taper 18. The other axial end forms a rear base portion or case head 20 having a rim 22 that forms, with the jacket 12 a groove 24. A bullet 28 serves as a projectile, while the case or jacket 12 holds all the parts together. The rim 20 includes, at its outer surface a primer cavity 26 that is used to ignite propellant placed within the interior cavity 15 as is well known in the art. The rim 22 provides the extractor on the firearm a place to grip the casing to remove it from the chamber once fired.

Figure 2:
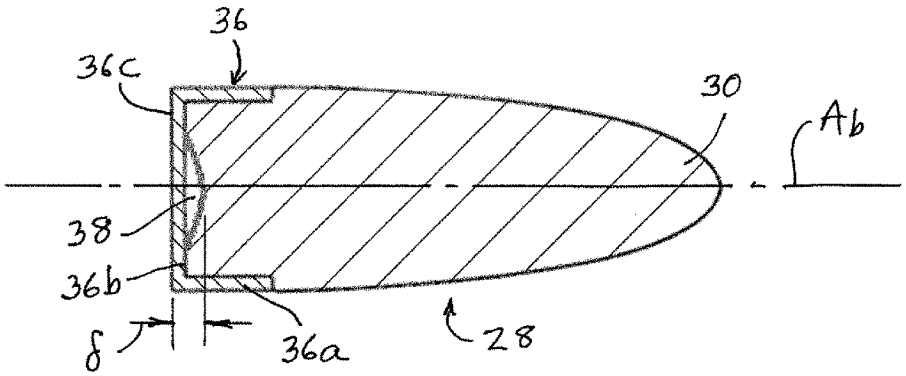
FIG. 2 is an enlarged side elevation view, in cross section, of the assembled bullet shown in FIG. 1.

Referring to FIGS. 1 and 2, the bullet 28 includes a lead core 30 which is shown to be conical. However, it would be clear from the description that follows that the specific shape of the leading end of the bullet or projectile is not critical for purposes of the present invention. The lead core 30 may, therefore, exhibit a hollow point, a soft point, a round or flat nose, etc., instead of a conical point as shown. The bullet 28 defines an axis of symmetry $A_b$ shown in FIG. 1. The leading end of the lead bore is formed at the remote axial and while the trailing or the axially proximate end is formed with a cylindrical stub 32 that has a diameter D1 dimensioned to be received within a cylindrical energy transmitting element such as a cap in the shape of a cup 36. The cap 36 is shown to have a coaxial cylindrical wall 36*a* and a transverse circular wall 36*b* normal to the axis $A_b$. The reduced diameter D1 of the stub 32 at t1 is selected to be received within the internal volume or space 40 of the cap 36 and secured thereto in any conventional manner, such as press-fit or bonded in any suitable way. The axial length d1 of the stub 32 is selected to generally correspond to the axial dimension d2 of the internal space, volume or cavity 40 of cup 36 so that when the stub 32 is inserted into the cup 36 at least a portion of an interfacing surface 34 butts against the transverse wall 36*a* of the cup 36 while an exposed circular surface 36*c* now interfaces with said cavity 15. For reasons that will be discussed more fully, the exposed surface 34 of the cylindrical stub 32 may be formed with a concave surface 38 to create an internal recess or clearance δ. It is to be noted that the space, gap or clearance δ need not be formed by a concave surface 38 as shown and the specific shape of the surface 38 is not critical. Thus, the surface 38 may assume a rectangular, elliptical, conical or other desired surface as long as a gap or space is formed between at least a portion of the cup and the surface 34 for optimum results.

An important feature of the invention is that the element or component represented by the cup or cap 36 is formed of an amorphous metallic alloy having properties of bulk metallic glass (BMG). Such amorphous metallic alloy also typically has a yield strength in excess of 870 MPA, a hardness in excess of 340 Vickers and an elasticity in excess of 1.0%. The material from which the cup 36 is made, therefore, is an amorphous alloy that is not crystallized as most metals. FIGS. 3*a*-3*b* illustrate the grains for crystalline metals such as magnesium, aluminum, titanium and stainless steel. FIG. 3*c* illustrates the consistency of amorphous metal, which does not exhibit grains that can shift or rub against each other when exposed to external forces or pressures thereby avoiding loss of energy when impacted. One example of an amorphous metal that can be used for this purpose is a high strength alloy material LM001B produced by Liquid Metal Technologies, Inc. located in Rancho Santa Margarita, Calif. 92688. Such amorphous metals can be precision shaped-molded with a shrinkage rate at 0.2% so that the parts can be plastic injection molded with great accuracy and precision. The alloy in question is stronger than high strength titanium with a yield strength of 1640 MPa. These alloys also have a very high hardness. An important property of such amorphous alloy is that they can undergo in excess of approximately 1.0% elongation before reaching its yield point. For example, the alloy LM001B can undergo 2.0% elongation before reaching its yield strength in excess of 1500 MPa. The combination of high yield strength, high hardness and superior elastic limit makes this material ideal for use between the actual lead core 30 of the bullet 28 and the case or jacket 12 where the propellant is ignited. The cap layer has the ability to restore energy imparted to the cap layer to the expanding propellant gases to reinforce them and enhance the composite forces on the projectile to enhance its initial velocity.

Figure 4:
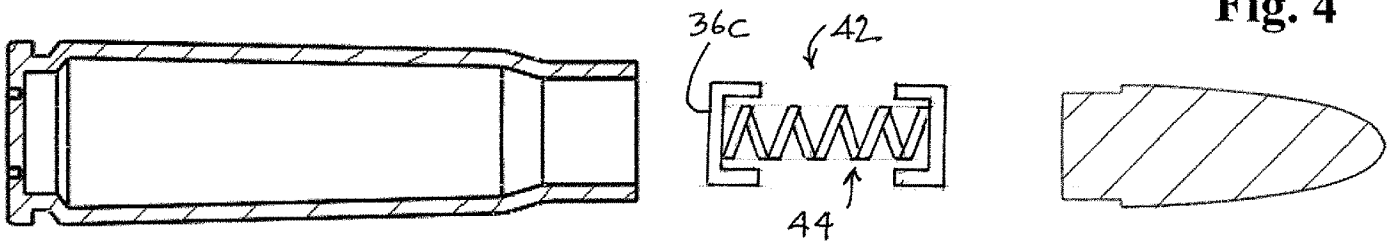
FIG. 4 is similar to FIG. 1 but diagrammatically illustrate a functional analog of a portion of the bullet construction representing the bullet shown in FIG. 3.

Referring to FIG. 4, the cup 36 in FIGS. 1 and 2 is illustrated in diagrammatically and represented by a mechanical analog 42 that includes a compression spring 44. Because of the properties of the amorphous alloy of which the cup 36 is formed it can efficiently store and retrieve energy. Therefore, when the propellant is ignited within the case or jacket 12 the explosion creates a significant amount of energy part of which is stored within the cup 36, partially as a result of its own elastic deformation. Part of that energy is also stored by the deflection of the wall 36*b* which at least partially enters within and partially conform with the gap or clearance δ formed by the concave surface 38. However, because the amorphous alloy has a high elastic strength any deformations in the wall 36*b* itself or its own deformation within the clearance or space 6 resulting from a storage energy can be retrieved and used to reinforce the continued expanding gas from the ignited propellant to additionally propel the bullet in the direction along its trajectory due to the exposure or contact of the wall 36*b* with the explosion or burst of energy. Now, therefore, while enhancing or increasing the initial velocity of the bullet 28 as a result of conservation of the energy due to the explosion within the bullet the compression spring 44, in the analog model, is compressed. However, the compression spring has a very high spring constant or constant factor k (according to Hooke's Law). As is known, Hooke's equation, in fact, applies in many other situations where an elastic body is deformed. An elastic body or material for which the equation can be assumed is said to be linear-elastic. Because of the aforementioned properties of the amorphous metals and alloys and, in particular, elastic limit, the wall 36*b* can be deformed under very high stresses without reaching its yield strength. For the reasons described, amorphous metal alloys are ideal for capping or terminating the trailing ends of the projectiles or bullets exposed to the explosive forces within the case or jacket 12.

Figure 5:
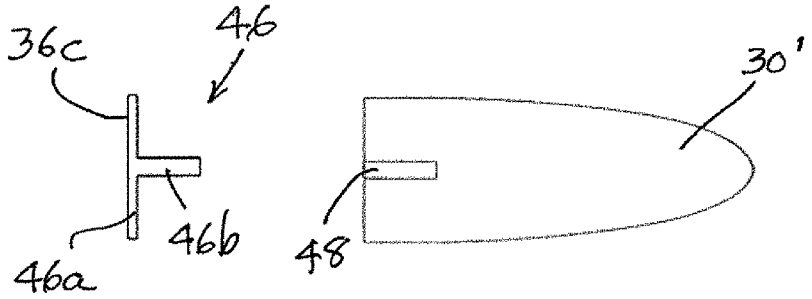
FIG. 5 is similar to FIG. 3 but illustrates another embodiment of the bullet construction.
Figure 7:
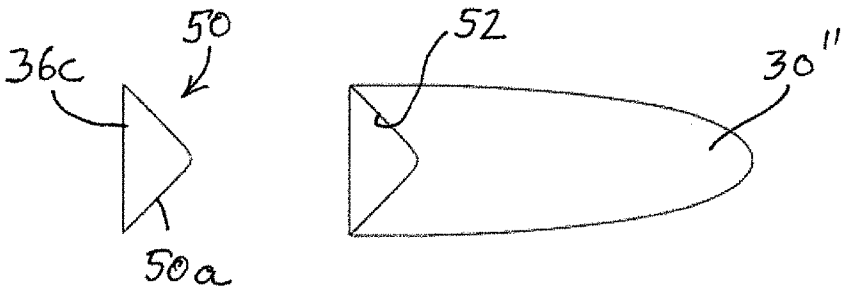
FIG. 7 is similar to FIG. 3 but illustrates a still further embodiment of a bullet construction in accordance with the present invention.
Figure 6:
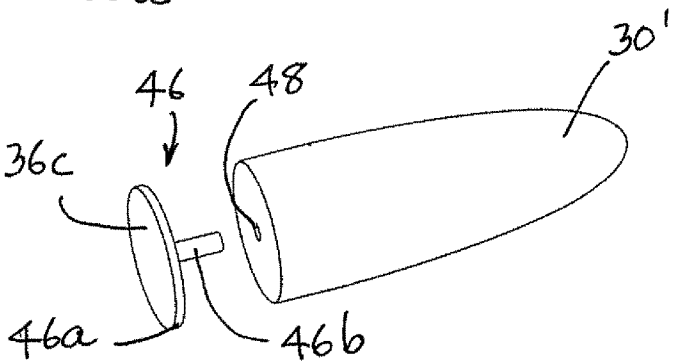
FIG. 6 is a rear perspective view of the cartridge shown in FIG. 5, providing additional details of the bullet construction.

As suggested, the axial end of the bullet exposed to the explosive chamber need not be in the form of a cup 36 as shown in FIGS. 1-3. Other shapes can be used with different degrees of advantage. Thus, for example, FIGS. 5 and 6 illustrate the downstream or trailing end of a bullet terminated by another embodiment 46 of an energy storage and restoring element instead of the cup 36. The embodiment 46 includes a generally circular disk 46*a* from the center of which there it projects an axial pin or rod portion 46*b* that is receivable within an axial bore, cavity or recess 48 of a modified bullet 30' shown in FIG. 6. Again, the item 46 may be press fit and secured to a lead bullet and it remains with the bullet before and after the bullet is propelled from the cartridge. Similarly, a further embodiment 50 of an energy storage element is shown which is generally conical in shape as shown in FIG. 7, a conical surface 50*a* of which is receivable within a conical recess 52 in a modified lead bullet 30". The manner in which the conical component or element 50 is secured to the lead bullet 52 is not critical and any suitable method of permanent or semi-permanent attachment can be used. In each of the examples, the energy storage elements of 36, 46 or 50 can exhibit the same or similar deformation before reaching it yield strength and store energy which can be immediately returned to the bullet and converted to kinetic energy to propel the bullet and increase its velocity.

Referring now to FIGS. 8*a*-8*d* side elevations and cross sections of a further embodiment of the invention are illustrated and generally designated by reference numeral 54. The cartridge 12 is essentially as previously described. However, the projectile or bullet 30'" includes a recessed curved surface 54' which, in the example shown, is in the form of a spherical surface. It will be appreciated, however, that the surface 54' need not be a perfect spherical surface but may be another curved surface such as spheroid, ellipsoid, hyperboloid and paraboloid. The cap 54" has a generally circular flat surface 36*c* facing the explosion or combustion chamber or cavity 15. The cap 54' has a curved surface 54" that conforms to the interior surface 54' of the cavity or recess. In the embodiment shown, the surfaces 54' and 54'" are surfaces of a hemisphere. However, as suggested above, these surfaces can include any curved three dimensional surfaces as long as these surfaces conform so that the cap can properly fit within and fill the recess of the projectile or bullet.

Figure 8A:
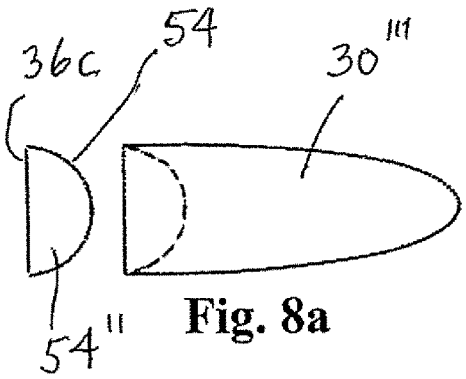
FIG. 8*a*-8*d* are exploded elevations (FIGS. 8*a*, 8*c*) and cross-sections (FIGS. 8*b*, 8*d*) of still a further embodiment of a bullet construction embodying the invention.
Figure 8B:
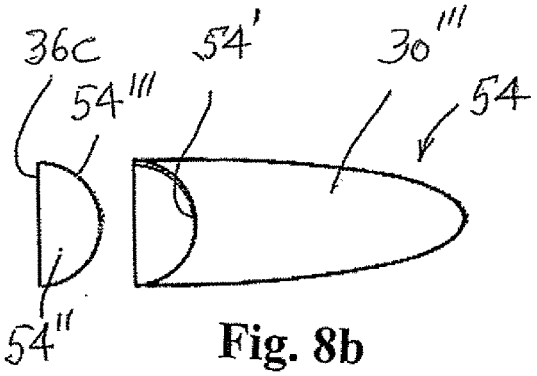
Figure 8C:
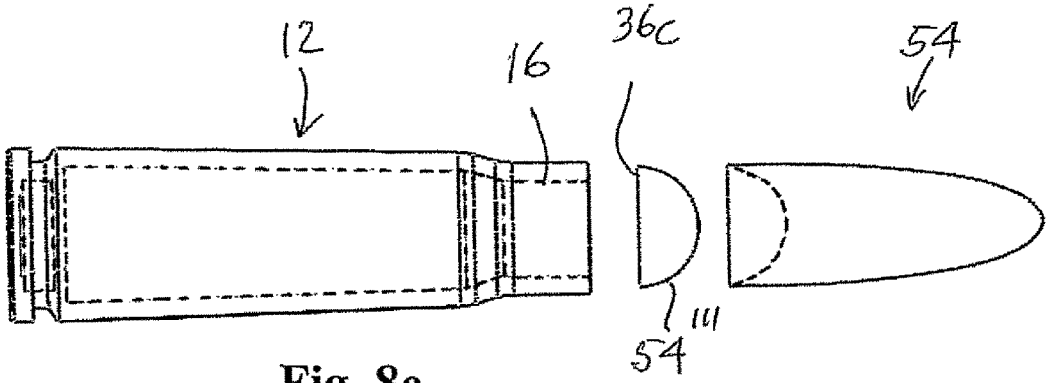
Figure 8D:
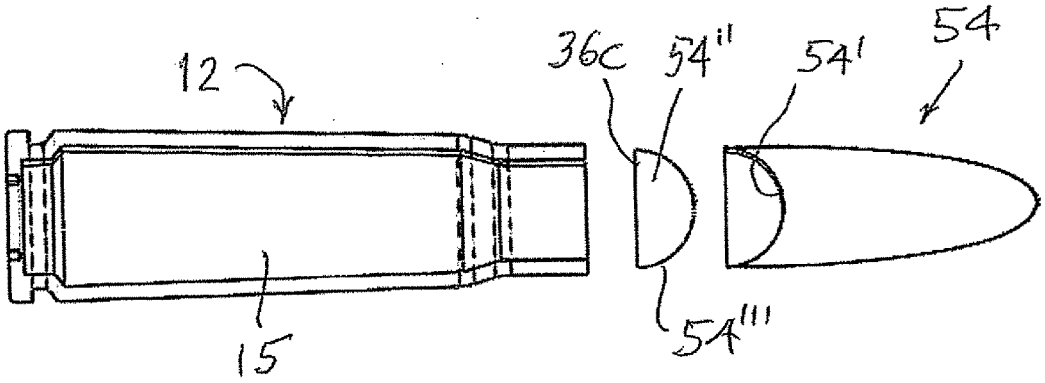

FIGS. 9*a* and 9*b* are similar to FIGS. 8*a* and 8*b* but show a modified rear surface 36*c*' on cap 70, the rear surface 36' interfacing with the propellant containing chamber or cavity having a recessed profile as shown.

FIGS. 10*a* and 10*b* illustrate yet another embodiment showing a modified cap 72 that has a disc 72*a* with a flat surface 36*c* exposed to the propellant contained in the chamber or cavity but has a bulbous projection 72*b* extending towards the core or bullet 74 that is provided with a substantially conforming recess 74' for retaining the cap 72 once the projection 72*b* is urged into the recess 74'.

The invention not only applies to the use of amorphous metal in conventional cartridges or bullets but the same or similar construction can also be used in other forms of munitions comprising any cartridge case integrated with a projectile, such as armor piercing cartridges. Referring to FIG. 11, a cross-section is shown of an armor piercing, fin-stabilized discarding sabot-tracer cartridge 54 which is a kinetic energy armor defeating round such as the 120 mm M829 APFSDS-T armor-piercing cartridge, the M829A1 anti-armor weapon and the M829A2 APFSDS armor defeat cartridge. In the example shown in FIG. 11, a fin-stabilized six bladed aluminum fin 56 operates with the projectile comprising a penetrator 58 with a ballistic tip 60. The propulsion system uses a case 62 with a combustible wall. A light weight sabot 64 is used made of a carbon-epoxy composite. The sabot 64 seals any clearance, space or gaps between the projectile and the inner surface of the bore 66 in the neck 16 to maximize the force on the projectile while decreasing friction against the bore. This is intended to increase the muzzle velocity while operating at slightly lower pressure. However, the use of common crystalline metals or carbon-epoxy composites for the sabot causes some of the energy from the exploded propellant to be absorbed and lost when that energy is used to deform the sabot. In accordance with the present invention, the surfaces of the portions of the sabot exposed to the explosion chamber 64 within the cavity of the case 62 are covered with a layer or coating 68 of hard amorphous metal, such as LIQUIDMETAL® to avoid such losses of energy and, therefore, transferring almost all of the energy to the projectile, this resulting in higher muzzle velocities. The same concept can be used in connection with any other munitions that involve the transfer of energy from explosive combustible propellants to a projectile whose muzzle velocity is to be maximized. A suitable interface between the projectile and the combustible propellants, using amorphous metals on the exposed surface of a cap, coating or layer, will result in such maximum muzzle velocities in accordance with the invention.

The invention also contemplates the use of amorphous metal alloy in other munitions that do not include a cartridge as described. For example, heavy field guns such as the 155 mm Gun M1917 or M1918 and Cannon 155 mm GPF that use separate loading eased charge. The layer, cap or coating of amorphous metallic alloy can be used to reduce energy losses by covering the wadding or even the outer surface of the projectile exposed to the explosive propellants.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A munition cartridge comprising a casing defining an axis and having a neck opening at one axial end and a closed rear portion at the other axial end to form a cavity or chamber for propellant; a projectile comprising a bullet core releasably mounted on said neck opening to seal said cavity or chamber and for propelling said projectile along said axis when propellant is ignited, said bullet core having an interfacing surface substantially covering said neck opening at said one axial end to close said cavity or chamber when said bullet core is mounted on said neck for propelling said bullet core upon combustion of said propellant to release said bullet core from said casing when exposed to pressures and forces created within said cavity or chamber when the propellant is ignited, said projectile also including a coating or cap covering said interfacing surface of said bullet core, said coating or cap being at least partially formed of an amorphous metallic alloy, whereby energy initially conserved or stored within said coating or cap is subsequently released and imparted to said bullet core to propel said projectile along a greater than normal trajectory.

2. A cartridge as defined in claim 1, wherein said projectile is a bullet.

3. A cartridge as defined in claim 1, wherein said projectile is an armor-piercing penetrator with a ballistic tip.

4. A cartridge as defined in claim 1, wherein said interfacing surface is circular and said coating or cap is cylindrically covering said interfacing surface and providing an exposed circular surface normal to said axis facing said cavity or chamber.

5. A cartridge as defined in claim 1, wherein said interfacing surface is circular with an axial opening, wherein said coating or cap is a cap and said cap comprises a circular disc covering said circular surface and a pin projecting into said axial opening to retain said disc to said projectile to provide an exposed circular surface normal to said axis facing said cavity or chamber.

6. A cartridge as defined in claim 1, wherein said interfacing surface is formed by a conical recess in said projectile, wherein said coating or cap is a cap and said cap includes a conical projection conforming to said conical recess and an exposed circular surface normal to said cavity or chamber facing said cavity or chamber.

7. A cartridge as defined in claim 1, wherein said projectile includes an axial portion extending into said cavity or chamber and defining a predetermined external surface, wherein said coating or cap is a coating comprising a layer conforming to said predetermined external surface.

8. A cartridge as defined in claim 7, wherein said axial portion comprises a plurality of cylindrical portions stepped to successively increase in diameter in the direction of said neck opening.

9. A cartridge as defined in claim 1, wherein said interfacing surface is formed by a predetermined curved surface in said projectile, wherein said coating or cap is a cap and said cap includes an external surface that conforms to said predetermined curved surface.

10. A cartridge as defined in claim 1, wherein said interfacing surface forms a sector of a sphere.

11. A cartridge as defined in claim 10, wherein said curved interfacing surface comprises a surface of a hemisphere.

12. A cartridge as defined in claim 1, wherein said amorphous metallic alloy is LIQUIDMETAL®.

13. A cartridge as defined in claim 1, wherein said amorphous metallic alloy has a yield strength in excess of 870 MPA, a hardness in excess of 340 Vickers and an elasticity in excess of 1.5% at a yield strength in excess of 1500 MPA.

14. A cartridge as defined in claim 1, where said amorphous metallic alloy has yield strength in excess of 870 MPA, a hardness in excess of 340 Vickers and an elasticity in excess of 2.0% at a yield strength in excess of 1500 MPA.

15. A munition for use in a cannon having a casing defining an axis and having a neck opening at one axial end and a closed rear portion at the other axial end to form a cavity or chamber for propellant comprising a projectile comprising a bullet core releasably mounted on said neck opening to seal said cavity or chamber and for propelling said projectile along said axis when propellant is ignited, said bullet core having an interfacing surface substantially covering said neck opening at said one axial end to close said cavity or chamber when said bullet core is mounted on said neck for propelling said bullet core upon combustion of said propellant to release said bullet core from said casing when exposed to pressures and forces created within said cavity or chamber when the propellant is ignited, said projectile also including a coating or cap covering said interfacing surface of said bullet core, said coating or cap being at least partially formed of an amorphous metallic alloy that has a yield strength in excess of 870 MPA, a hardness in excess of 340 Vickers and an elasticity in excess of 1.5% at a yield strength in excess of 1500 MPA, whereby energy initially conserved or stored within said coating or cap is released and imparted to said bullet core to propel said projectile along a greater than normal trajectory.

* * * * *